US005327119A

United States Patent [19]

Ishii

[11] Patent Number: 5,327,119

[45] Date of Patent: Jul. 5, 1994

[54] IONIZING SMOKE SENSOR

[75] Inventor: Kanji Ishii, Yokohama, Japan

[73] Assignee: Hochiki Kabushiki Kaisha, Tokyo, Japan

[21] Appl. No.: 919,705

[22] Filed: Jul. 24, 1992

Related U.S. Application Data

[63] Continuation-in-part of Ser. No. 697,539, Apr. 30, 1991, abandoned, which is a continuation of Ser. No. 455,073, Dec. 22, 1989, abandoned.

[51] Int. Cl.[5] ..... G08B 17/10

[52] U.S. Cl. ..... 340/629; 340/628; 340/693

[58] Field of Search ..... 340/628, 629, 630, 693; 250/381

[56] References Cited

U.S. PATENT DOCUMENTS

| | | | |
|---|---|---|---|
| 3,908,957 | 9/1975 | Schütt | 340/629 X |
| 4,150,373 | 4/1979 | Reid, Jr. | 340/629 |
| 4,238,677 | 12/1980 | Hugon | 340/629 |
| 4,328,424 | 5/1982 | O'Conner | 340/629 X |

*Primary Examiner*—Jeffery A. Hofsass

*Attorney, Agent, or Firm*—Lackenbach Siegel Marzullo Aronson & Greenspan

[57] ABSTRACT

The present invention relates to an improvement of an ionizing smoke sensor having one radiation source and a two chambered structure consisting of an internal ionization chamber housing an internal electrode having a radiation source and defined by an intermediate electrode, and an external chamber where smoke can flow in, defined by an external electrode and irradiated from the radiation source through an opening in the intermediate electrode. Hitherto, in an ionizing smoke sensor having one radiation source and a two chambered structure, there has been a problem in that the giving of misinformation and noinformation occur when a little amount of thread, moisture or dust invades or a current of air flows an internal ionization chamber through an opening and an external ionization chamber. In addition, the electric field in the internal ionization chamber loses its homogeneity because of the opening, hence V-I characteristics preferable for the internal ionization chamber can not be obtained. Furthermore, stable V-I characteristics can not be obtained since hardly any smoke can hardly flow into the internal ionization chamber because of the mesh structure. In the ionizing smoke sensor of the present invention, the above described problems are solved by forming the opening part in the intermediate electrode with a mesh structure having a rate of porosity more than or equal to 50%.

5 Claims, 6 Drawing Sheets

IONIZING SMOKE SENSOR

This application is a continuation-in-part of application Ser. No. 697,539, filed Apr. 30, 1991 now abandoned, which is a continuation now abandoned of application Ser. No. 455,073, filed Dec. 22, 1989.

BACKGROUND OF THE INVENTION

1. Field of the Invention

The present invention relates to an ionizing smoke sensor having one radiation source and a two chambered structure comprising of an internal ionization chamber housing an internal electrode having a radiation source and defined by an intermediate electrode, and an external chamber where smoke can flow in, defined by an external electrode and irradiated from the radiation source through an opening in the intermediate electrode.

2. Description of the Related Art

Hitherto, an ionizing smoke sensor having one radiation source and a two chambered structure, for example, the sensor shown in FIG. 8, has been known.

In FIG. 8, an internal ionization chamber 1 (internal chamber) and an external ionization chamber 2 (external chamber) are formed in a body cover 20 and an outer cover 30.

The internal ionization chamber 1 is defined by an insulating member 3 and an intermediate electrode 4 and so constructed that smoke can hardly flow in. An internal electrode 6 having a radiation source 5 which generates pairs of ions is housed in this ionization chamber 1.

The external ionization chamber 2 is defined by an external electrode 7 which covers the outside of the internal ionization chamber 1 and the intermediate electrode 4. A smoke inflow entrance is installed in the external electrode 7 so that smoke can flow in when a fire occurs.

As shown in FIG. 9, an opening 8 is mounted on a part of the intermediate electrode 4 dividing the internal ionization chamber 1 from the external ionization chamber 2 facing the radiation source 5. The radiation irradiated from the radiation source 5 can irradiate the external ionization chamber 2 through this opening 8 and ion pairs can be generated in the external ionization chamber 2.

The operation of this ionizing smoke sensor will be explained as follows.

When voltage is applied between the external electrode 7 and the intermediate 4 and between the intermediate electrode 4 and the internal electrode 6, a faint electric current flows due to the movement of the ion pairs generated by the radiation source 5 from the minus pole to the plus pole due to an electric field generated in each of the ionization chambers and V-I characteristics which generate a specified voltage between the electrodes are obtained.

When the smoke flows into the external ionization chamber 2, the ion electric current flowing between the intermediate electrode 4 and the external electrode 7 decreases and the voltage between the electrodes rises because the mobile speed of the pairs of ions decreases because of the attachment of ion pairs to smoke particles. Then the smoke sensor detects that the smoke concentration has reached a specified value based on the change in the V-I characteristics of the external ionization chamber 2 and sends a fire detecting signal.

However, in this conventional ionizing smoke sensor, since the relatively large opening 8 through which the radiation passes is installed in the intermediate electrode 4 to generate the specified ion pairs in the external ionization chamber 2, a problem occurs, namely, a little amount of thread, moisture, dust and so on which flows into the external ionization chamber 2 invade the internal ionization chamber 1 through the opening 8 and cause misinformation to be given, or a current of air which flows into the internal ionization chamber 1 from the external ionization chamber 2 through the opening 8 carries away the ion pairs, fluctuates the reference voltage and causes sensitivity change to be given.

In addition, since the part where the opening 8 is formed does not have the same function as the intermediate electrode, problems occur, namely, the electric field is hardly formed in the part of the internal ionization chamber 1 facing the opening 8 and hence a sensor having the internal ionization chamber 1 with good V-I characteristics can not be obtained.

Conventional ionizing smoke sensors are described in U.S. Pat. Nos. 4,361,763 and 3,935,492.

Only a bar or a centerpiece is mounted on the opening hole of the intermediate electrode in the smoke sensor of U.S. Pat. No. 4,361,763, and this intermediate electrode is essentially the same as the intermediate electrode shown in FIG. 9 and has problems similar to those of the intermediate electrode shown in FIG. 9.

Although U.S. Pat. No. 3,935,492 discloses a structure having a meshed intermediate electrode, since the whole body of the intermediate electrode is meshed, there are problems in that it is easily affected by a current of air and the electric field is easily fluctuated by ion pairs being carried away.

SUMMARY OF THE INVENTION

The present invention has been devised to solve these above described conventional problems. The purpose of the present invention is to provide an ionizing smoke sensor which can prevent the disordering of ion pairs caused by the invasion of a little amount of thread, moisture, dust and so on into the internal ionization chamber and the inflow of a current of air and which can satisfactorily improve the V-I characteristics of the internal ionization chamber.

To accomplish the above purpose, there is provided in the present invention an ionizing smoke sensor comprising an internal ionization chamber housing an internal electrode having a radiation source and defined by an intermediate electrode, and an external ionization chamber where the smoke can flow in from the outside formed at the outside of the internal ionization chamber and defined by an external electrode, the internal and external chambers being formed in the cover, and radiation being irradiated from the radiation source to the external ionization chamber through an opening part installed in a part of the intermediate electrode facing the radiation source, the opening part of the intermediate electrode being made of a mesh structure with a rate of porosity more than or equal to 50%.

In addition, according to the preferred embodiments of the present invention, the mesh structure is formed by attaching the meshed opening plate to the opening part or by stamping the center part facing the radiation source of the intermediate electrode to form a meshed opening part.

In the ionizing smoke sensor of the present invention having this structure, the invention of a little amount of thread, moisture, dust and so into the internal ionization chamber through the opening part which causes misinformation to be given can be satisfactorily prevented, since the opening part of the intermediate electrode has the mesh structure.

In addition, since the opening part is defined as the mesh structure with a rate of porosity more than or equal to 50%, the external ionization chamber can be almost similarly irradiated with radiation to the irradiation through the opening.

Furthermore, the electric field can be effectively generated at the opening part of the internal ionization chamber by making the opening part with the mesh structure, and as a result, the V-I characteristics of the internal ionization chamber can be improved.

DESCRIPTION OF THE PREFERRED EMBODIMENTS

The preferred embodiments of the present invention will be explained as follows, together with reference to the figures.

Figure 1:
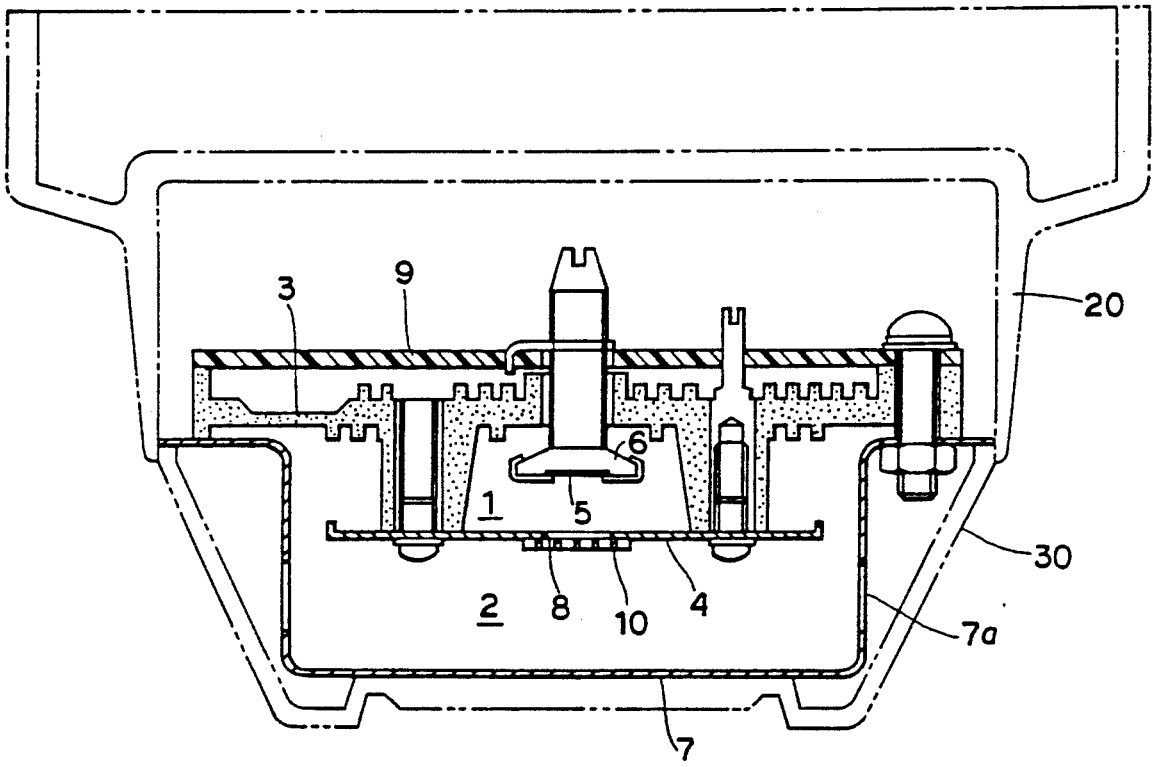
FIG. 1 is a sectional view of one embodiment of the present invention.
Figure 2:
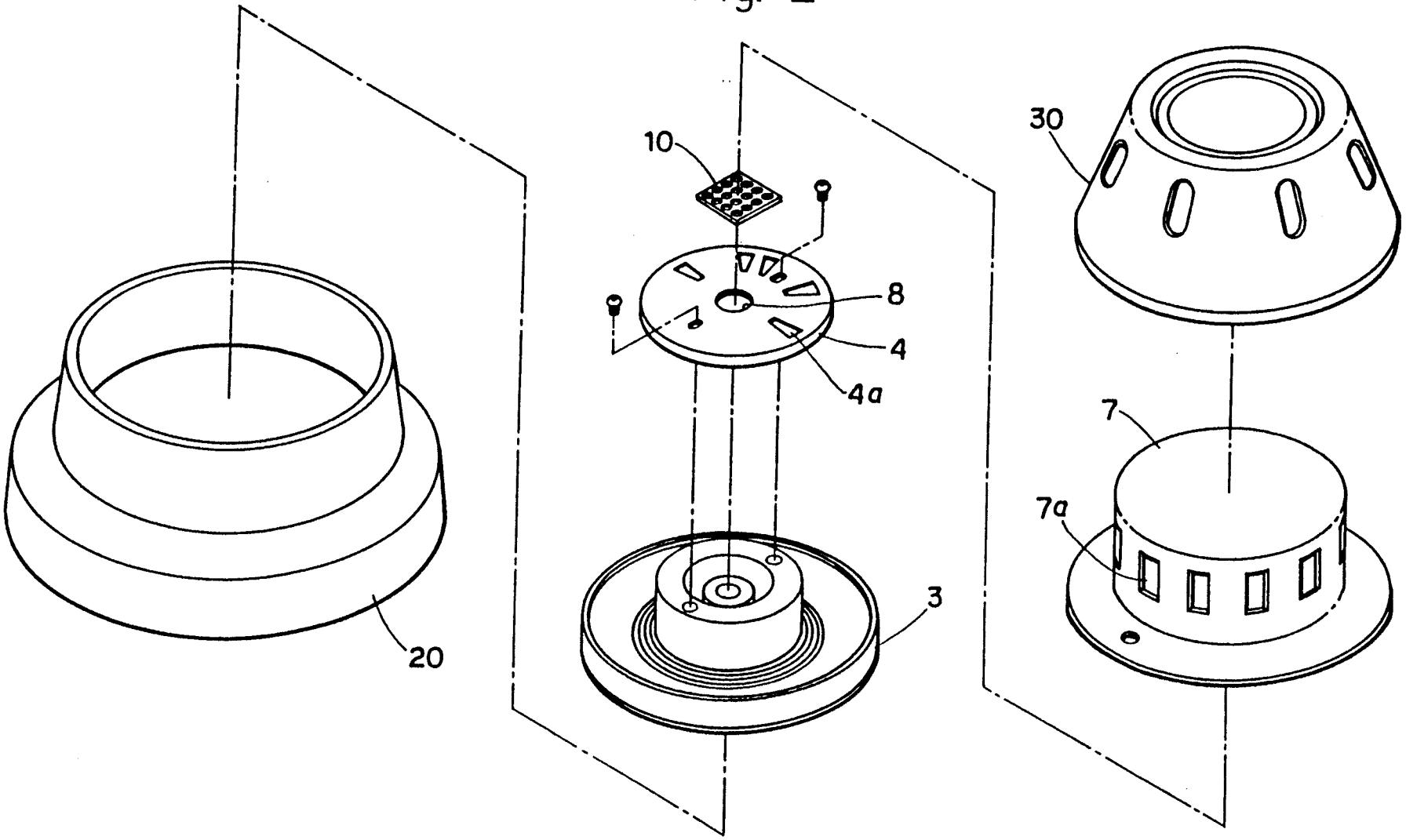
FIG. 2 is an exploded perspective view of the sensor in accordance with one embodiment of the present invention.

As shown in FIGS. 1 and 2, an ionizing smoke sensor of the present invention has a body cover 20 mounted on the side of ceiling surface and an outer cover 30 removably mounted on the body cover 20 and having smoke inflow entrances surrounding the outer cover 30. An internal ionization chamber 1 and an external ionization chamber 2 are formed in this body cover 20 and the outer cover 30.

The internal ionization chamber 1 is defined by an insulating member 3 and an intermediate electrode 4, and an internal electrode 6 whose lower end is caulkingly fastened to a radiation source 5 is housed in this internal ionization chamber 1. The internal electrode 6 is supported by the insulating member 3 and is electrically connected to a circuit board 9 positioned at the upper part of the sensor.

An external electrode 7 having a surrounding smoke inflow entrance *7a* where smoke can flow in from outside is installed in a position covering the outer side of the internal ionization chamber 1 defined by the insulating member 3 and the intermediate electrode 4, and the external ionization chamber 2 is defined by this external electrode 7. Needless to say, both the intermediate electrode 4 and external electrode 7 are supported by and fastened to the insulating member 3.

An opening 8 is mounted on the part of the intermediate electrode 4 facing the radiation source 5 of the internal electrode 6 housed in the internal ionization chamber 1, and a meshed opening plate 10 having many mesh holes is fastened to the lower side of the opening 8 by, for example, spot welding and so on.

Figure 3:
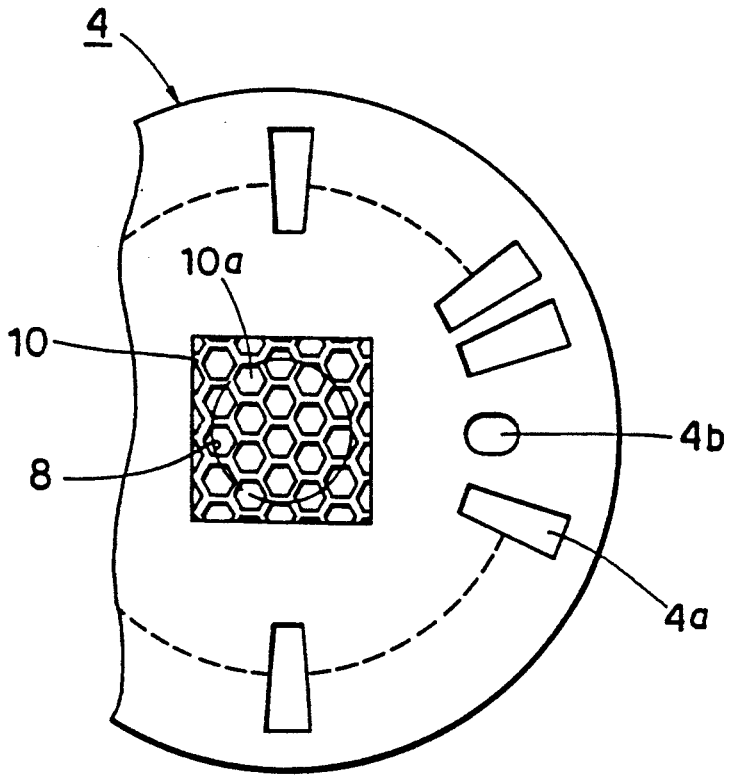
FIG. 3 is a plan view of the intermediate electrode shown in FIG. 1.

As the plan view of the intermediate electrode 4 seen from the lower side shows in FIG. 3, the opening 8 is given a mesh structure by installing the meshed opening plate 10 having many hexagonal mesh holes 10*a* in the lower side of the opening 8. In addition, smoke passing holes 4*a* are peripherally placed on the intermediate electrode 4 at specified pitch intervals. 4*b* denotes a mounting hole for the intermediate electrode 4 on the insulating member 3.

The size of the mesh is determined so that the mesh holes 10*a* of the meshed opening plate 10 has a rate of porosity more than or equal to 50% per unit area; so that the incident dose of the radiation irradiated from the radiation source 5 to the external ionization chamber 2 will not be spoiled; to prevent the invasion of a little amount of thread, moisture and dust to the internal ionization chamber 1; to properly suppress the inflow of the current of air and to effectively generate the electric field in the internal ionization chamber 1 facing the opening 8. In this embodiment, the mesh holes 10*a* is determined to have a 65% rate of porosity.

Needless to say, since the meshed opening plate 10 also has the same function as the intermediate electrode 4, the same metal plate as is used in the intermediate electrode 4 is used in the meshed opening plate 10.

The operation of the embodiment shown in FIG. 1 will be explained.

First, many smoke inflow holes *7a* are installed in the perimeter of the external electrode 7 defining the external ionization chamber 2 to make it possible for smoke to inflow from outside and gauze is usually installed on the outside of the smoke inflow holes *7a* to prevent an invasion of insects. However, there is the possibility that a little amount of thread, moisture and dust may invade the external ionization chamber 2 through the gauze on the mesh.

However, a little amount of thread and so on invading the external ionization chamber 2 can not pass the mesh holes 10*a* of the meshed opening plate 10 because the meshed opening plate 10 is fastened in the opening 8 of the intermediate electrode 4, thus an invasion by a little amount of thread and so on of the internal ionization chamber 1, which could change the V-I characteristics of the internal ionization chamber 1 and cause a misoperation can be reliably prevented.

On the other hand, as is obvious from FIG. 2, because the meshes of the meshed opening plate 10 are uniformly dispersed throughout the whole of the opening 8 and the rate of porosity of the meshed opening plate 10 is more than or equal to 50%, the incident dose of the radiation sent from the radiation source 5 mounted on the internal electrode 6 housed in the internal ionization chamber 1 to the external ionization chamber 2 is almostly unchanged compared to when the meshed opening plate 10 is not mounted in the opening 8, and a sufficient amount of ion pairs can be generated in the external ionization chamber 2 by the irradiation of the radiation.

In addition, the opening having the above mesh structure which acts as the electrode is formed on a part of the internal electrode 4 by installing the meshed opening plate 10 in the opening 8. As a result, the electric field can be effectively generated in the region facing the internal electrode 6 of the internal ionization chamber 1 and the opening 8, so that the distribution of the electric field in the internal ionization chamber 1 between the internal electrode 6 and the intermediate electrode 4 becomes almost homogeneous and the ion electric current can be increased by increasing the total amount of the moving ion pairs. Therefore, the V-I characteristics of the internal ionization chamber 1 can be improved.

Figure 4:
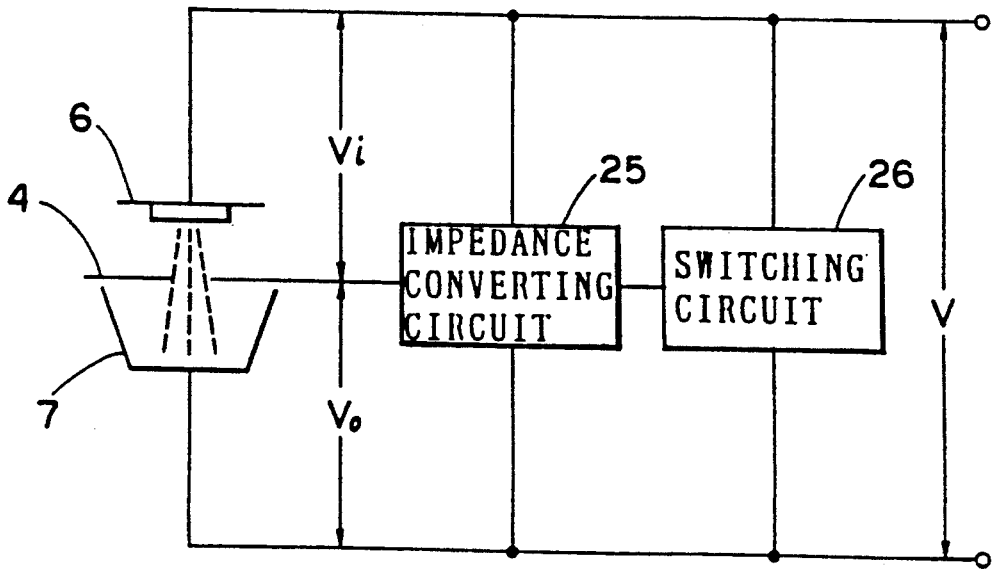
FIG. 4 is a circuit diagram showing the principle of the ionizing smoke sensor.

FIG. 4 is a diagram showing the principle of the ionizing smoke sensor of the present invention. In FIG. 4, Vi and Vo denote the voltage between the internal electrode 6 and the intermediate electrode 4, and the voltage between the intermediate electrode 4 and the external electrode 7, respectively. I, Vi' and Vo' denote the electric current and the voltages after changing of Vo and Vi, respectively.

Figure 5:
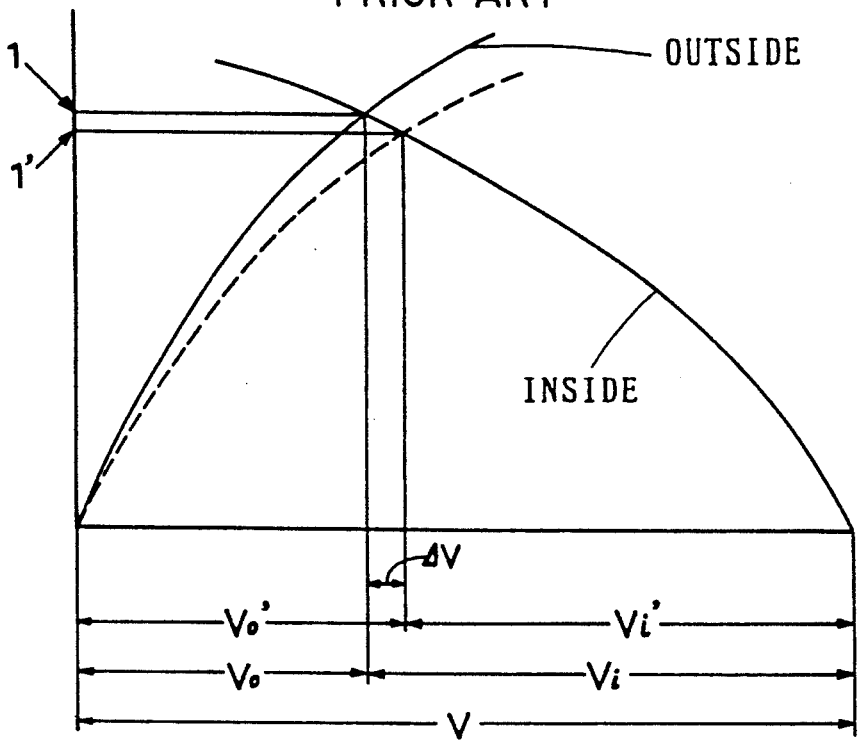
Fig. 5 PRIOR ART
FIG. 5 and FIG. 6 show the V-I characteristics of the conventional ionizing smoke sensor and the present invention's ionizing smoke sensor, respectively.
Figure 8:
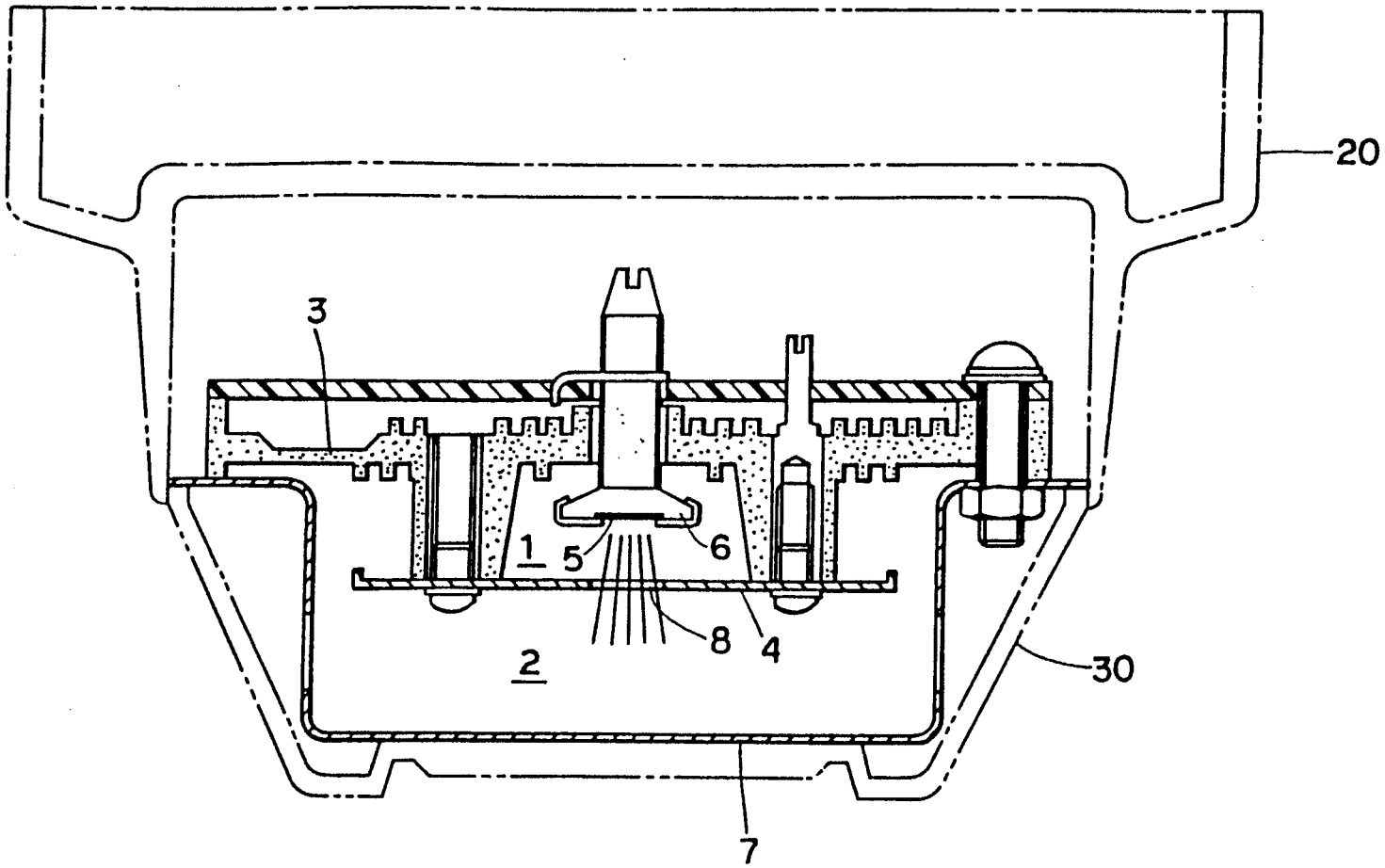
Fig. 8 PRIOR ART
FIG. 8 is a sectional view of the conventional ionizing smoke sensor.

The V-I characteristics of the conventional sensor shown in FIG. 8 is as shown in FIG. 5. When smoke flows in the external ionization chamber 2 at the time of a fire and so on, the ion current is decreased by the interference of smoke particles and the V-I characteristics of the external electrode change as shown by the broken line. At this time, the voltage changes by V and this change is judged to be a fire when this change V exceeds the specified level.

In the conventional sensor, since the opening 8 of the intermediate electrode 4 does not have the same function as the intermediate electrode, the ion electric current flowing into the internal ionization chamber 1 is reduced at the portion where the opening 8 is formed, and as a result, the gradient of the characteristic curve of the internal electrode 6 is enlarged as shown in FIG. 5. Therefore, the voltage change V accompanied by the change in the V-I characteristics of the external electrode 7 is reduced and stable detection of smoke can not take place.

Figure 6:
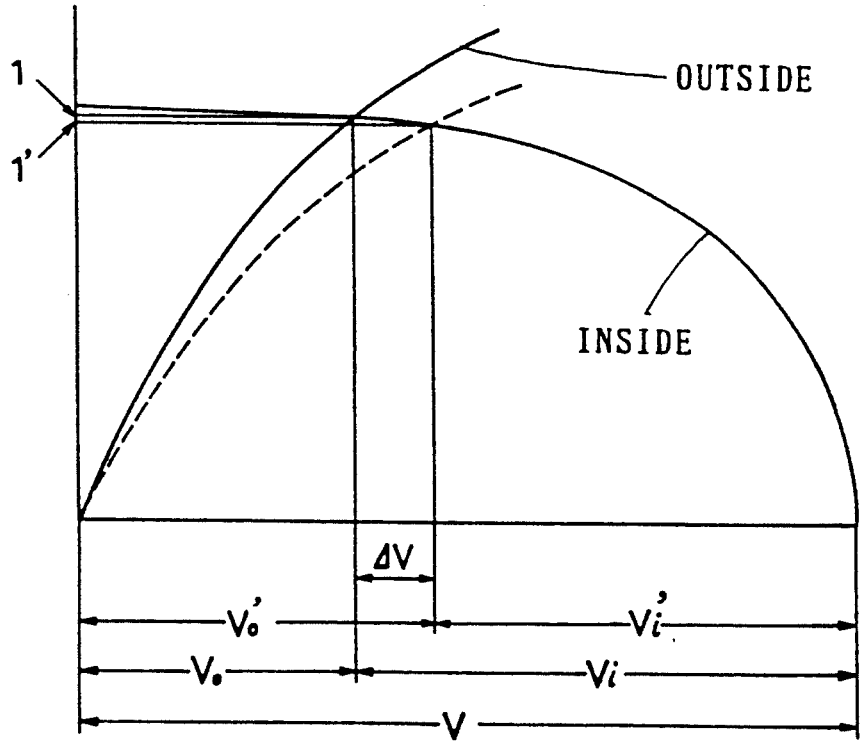

In contrast, in the sensor of this embodiment of the present invention, the distribution of the electric field in the internal ionization chamber 1 is made homogeneous by the meshed opening plate 10, as described above, and the value of the ion electric current in the internal ionization chamber 1 can be saturated, as shown in FIG. 6, because the amount of the moving ion pairs increases. As a result, the V-I characteristics of the internal electrode 6 become favorable, with no gradient. Therefore, the voltage change V accompanied by the change in the V-I characteristics of the external electrode 7 becomes greater than that of the conventional type and stable detection of smoke can take place.

Furthermore, the amount of smoke flowing into the internal ionization chamber 1 of the present invention is greater than the amount of smoke flowing into the internal ionization chamber 1 of the conventional smoke sensor due to the installation of the meshed opening plate 10 in the opening 8 even if the smoke flows into the external ionization chamber 2, and since the ion electric current in the internal ionization chamber 1 is saturated sufficiently, even if the current of air carried away the ion pairs, the problems concerning the fluctuation of the reference voltage is minimized. Therefore, the stability of the internal ionization chamber 1 which acts as the standard chamber at the time of the inflowing of the smoke can be improved and the giving of misinformation and noinformation can be prevented.

Figure 7:
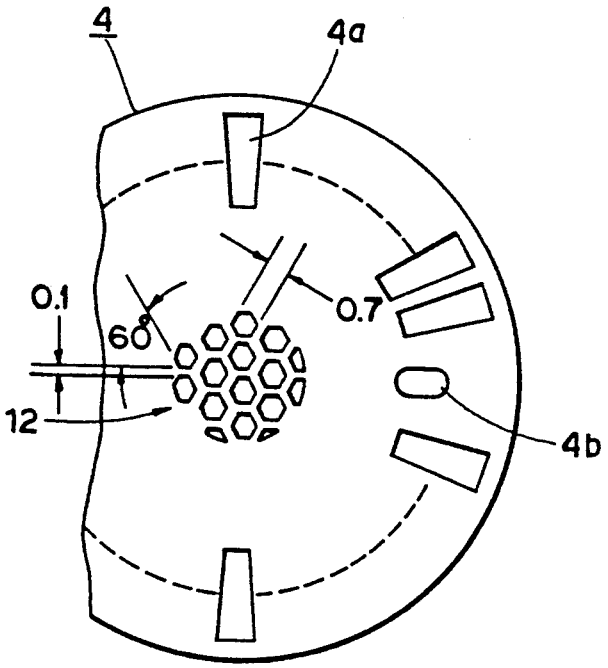
FIG. 7 is a plan view of another embodiment of the intermediate electrode of the present invention.
Figure 9:
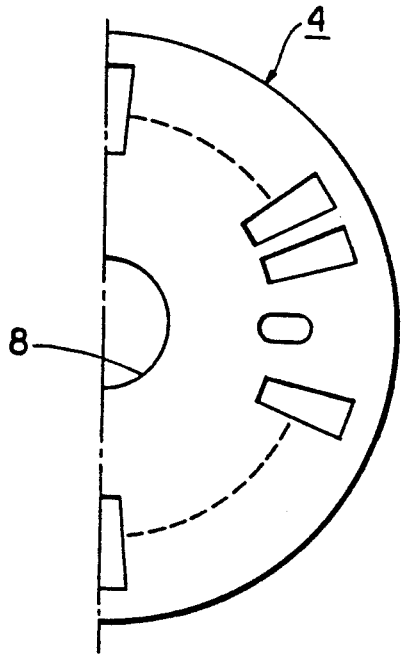
Fig. 9 PRIOR ART
FIG. 9 is a plan view of the ionizing smoke sensor after removal of the conventional intermediate electrode.

FIG. 7 explains another embodiment of the intermediate electrode 4 of the present invention. In this embodiment, a meshed opening part 12 is formed on the center of the intermediate electrode 4 facing the radiation source 5 by stamping and so on.

By forming the meshed opening part 12 at the center of the intermediate electrode 4, its structure can be simplified and the cost is less than that of the embodiment shown in FIG. 1, in which the meshed opening plate 10 is installed as a separate member.

Although the mesh holes of the meshed opening plate 10 or the meshed opening part 12 are defined as the hexagonal holes in the above described embodiment, the form of the mesh holes can be circular, rectangular and so on when only a rate of porosity of more than or equal to 50% is maintained. Furthermore, gauze having a rate of porosity more than or equal to 50% can be installed.

What is claimed is:

1. An improved ionizing smoke sensor for detecting smoke having a two-chambered structure;

a body cover for mounting said smoke sensor to a surface, and an outer cover removably mounted to said body cover and having smoke inflow passageways;

a radiation source for irradiating radiation, an internal electrode having said radiation source extending through an insulating member, a plate-like intermediate electrode having opening means therein, an internal ionization chamber surrounding said internal electrode and defined by said intermediate electrode and said insulating member further extending about said internal electrode and contacting said intermediate electrode, said internal and intermediate electrodes exhibiting a voltage Vi therebetween, and said opening means comprising a mesh defining a plurality of apertures centrally disposed opposite to said internal electrode and said radiation source for enabling passage of radiation therethrough, an external electrode contacting and supporting said insulating member and being secured thereto, and an external ionization chamber where smoke can flow in from the outside disposed about the outside of said internal ionization chamber and defined by said external electrode, said intermediate electrode and said insulating member, and said external and intermediate electrodes exhibiting a voltage Vo therebetween, said internal chamber and said external chamber being concentrically disposed within said outer cover; and a voltage source being applied across said chambers, said radiation source irridating radiation to said external ionization chamber through said mesh, defined by said plurality of apertures which acts as a part of said intermediate electrode and faces said radiation source, and said mesh functioning as a part of the intermediate electrode in generating a flow of ions in said internal ionization chamber and in preventing the invasion of particles of thread, moisture, insects and dust to said internal ionization chamber as well as suppressing the rush of air flowing therethrough, and having a mesh structure with a rate of porosity of at least fifty (50) percent and less than eighty (80) percent by means of said plurality of apertures being in the range of from about 20 to about 50 mesh holes per inch, with said plurality of apertures centrally clustered so as to be disposed in juxtaposition to said radiation source; whereby the electric field distribution in said inner ionization chamber is rendered substantially homogenous so that fluctuation of the voltage Vi is minimized, thereby improving the ability of the improved sensor to more accurately detect a change in the smoke condition entering said sensor, and minimizing sensor error caused by the rushing air flow and invasion of said particles.

2. The improved ionizing smoke sensor according to claim 1, wherein said mesh structure is integral with and disposed at the center of said intermediate electrode facing said radiation source, and comprises a plurality of apertures in said intermediate electrode.

3. The improved ionizing smoke sensor according to claim 1, wherein said mesh structure comprises a metallic gauze element installed over said opening means of said intermediate electrode.

4. The improved ionizing smoke sensor according to claim 1, wherein said mesh structure has a rate of porosity of sixty-five (65) percent.

5. The improved ionizing smoke sensor according to claim 3, wherein said metallic element installed over said opening means is a meshed opening plate made out of sheet metal.

* * * * *